United States Patent [19]

Fletcher et al.

[11] 4,302,325

[45] Nov. 24, 1981

[54] SOLVENT EXTRACTION PROCESS FOR REREFINING USED LUBRICATING OIL

[75] Inventors: Laird C. Fletcher; Richard H. O'Blasny, both of Natchitoches, La.

[73] Assignee: Delta Central Refining, Inc., Natchitoches, La.

[21] Appl. No.: 202,015

[22] Filed: Oct. 28, 1980

[51] Int. Cl.[3] ..... C10G 21/16

[52] U.S. Cl. ..... 208/180; 208/251 R; 208/327

[58] Field of Search ..... 208/180, 251 R, 327

[56] References Cited

U.S. PATENT DOCUMENTS

| | | | |
|---|---|---|---|
| 1,584,588 | 5/1926 | Acheson . | |
| 2,583,620 | 1/1952 | Wrightson . | |
| 2,671,753 | 3/1954 | Lillard | 208/327 |
| 2,745,790 | 5/1956 | Manley | 208/327 |
| 3,024,171 | 3/1962 | Bone . | |
| 3,173,859 | 3/1965 | Chambers . | |
| 3,305,478 | 2/1967 | Gilson et al. . | |
| 3,450,627 | 6/1969 | Johnson et al. . | |
| 3,607,731 | 9/1971 | Gulick . | |
| 3,620,967 | 11/1971 | Gulick . | |
| 3,625,881 | 12/1971 | Chambers et al. . | |
| 3,763,036 | 10/1973 | Jordan et al. . | |
| 3,773,658 | 10/1973 | Vu et al. . | |
| 3,791,965 | 2/1974 | Fitzsimons et al. . | |
| 3,864,242 | 2/1975 | Watanabe . | |
| 3,870,625 | 3/1975 | Wielezynski . | |
| 3,879,282 | 4/1975 | Johnson . | |
| 3,919,076 | 11/1975 | Cutler et al. . | |
| 3,923,643 | 12/1975 | Lewis et al. . | |
| 3,929,626 | 12/1975 | Button et al. . | |
| 3,954,602 | 5/1976 | Troesch et al. . | |
| 3,980,551 | 9/1976 | Wolk . | |
| 3,985,642 | 10/1976 | Friel et al. . | |
| 4,021,333 | 5/1977 | Habiby et al. . | |
| 4,029,569 | 6/1977 | Ivey, Jr. . | |
| 4,033,859 | 7/1977 | Davidson et al. . | |
| 4,038,176 | 7/1977 | Noren et al. . | |
| 4,045,330 | 8/1977 | Avrillon et al. . | |
| 4,071,438 | 1/1978 | O'Blasny . | |
| 4,073,719 | 2/1978 | Whisman et al. . | |
| 4,073,720 | 2/1978 | Whisman et al. . | |
| 4,097,369 | 6/1978 | Ebel et al. . | |
| 4,101,414 | 7/1978 | Kim et al. . | |
| 4,105,538 | 8/1978 | Mattox . | |
| 4,124,492 | 11/1978 | Fung et al. . | |
| 4,140,212 | 2/1979 | O'Blasny et al. . | |
| 4,250,021 | 2/1981 | Salusinszky | 208/251 R |

FOREIGN PATENT DOCUMENTS

| | | |
|---|---|---|
| 49-69702 | 7/1974 | Japan . |

OTHER PUBLICATIONS

"Evaporators: Use in Re-refining" published in *Hydrocarbon Processing*, Jul., 1979.

"Waste Lubricating Oil Research", published in *Bureau of Mines Report of Investigations/* 1974-RI 7884 and 7925.

*Reprocessing and Disposal of Waste Petroleum Oils by L. Y. Hess published by Noyes Data Corporation.*

*Petroleum Refinery Engineering by W. L. Nelson, published by McGraw-Hill Book Company.*

*Primary Examiner*—Delbert E. Gantz
*Assistant Examiner*—Olik Chaudhuri
*Attorney, Agent, or Firm*—Richards, Harris & Medlock

[57] ABSTRACT

In accordance with the present invention, a process is provided for removing impurities from heavy and light lube oil fractions that have been obtained from waste lubricating oil. The impurities in the light lube oil fraction are removed utilizing tetrahydrofurfuryl alcohol in an extraction column (10). An oil-rich raffinate has the solvent removed therefrom by steam distillation and stripping at reduced pressure in a distillation tower (20). The heavy lube oil fraction is purified in a manner similar to the purification of the light lube oil fraction. The finished heavy and light lube oil may then be subjected to further treatment, such as polishing steps or additives may be blended into the lube oil product depending on the desired use.

13 Claims, 1 Drawing Figure

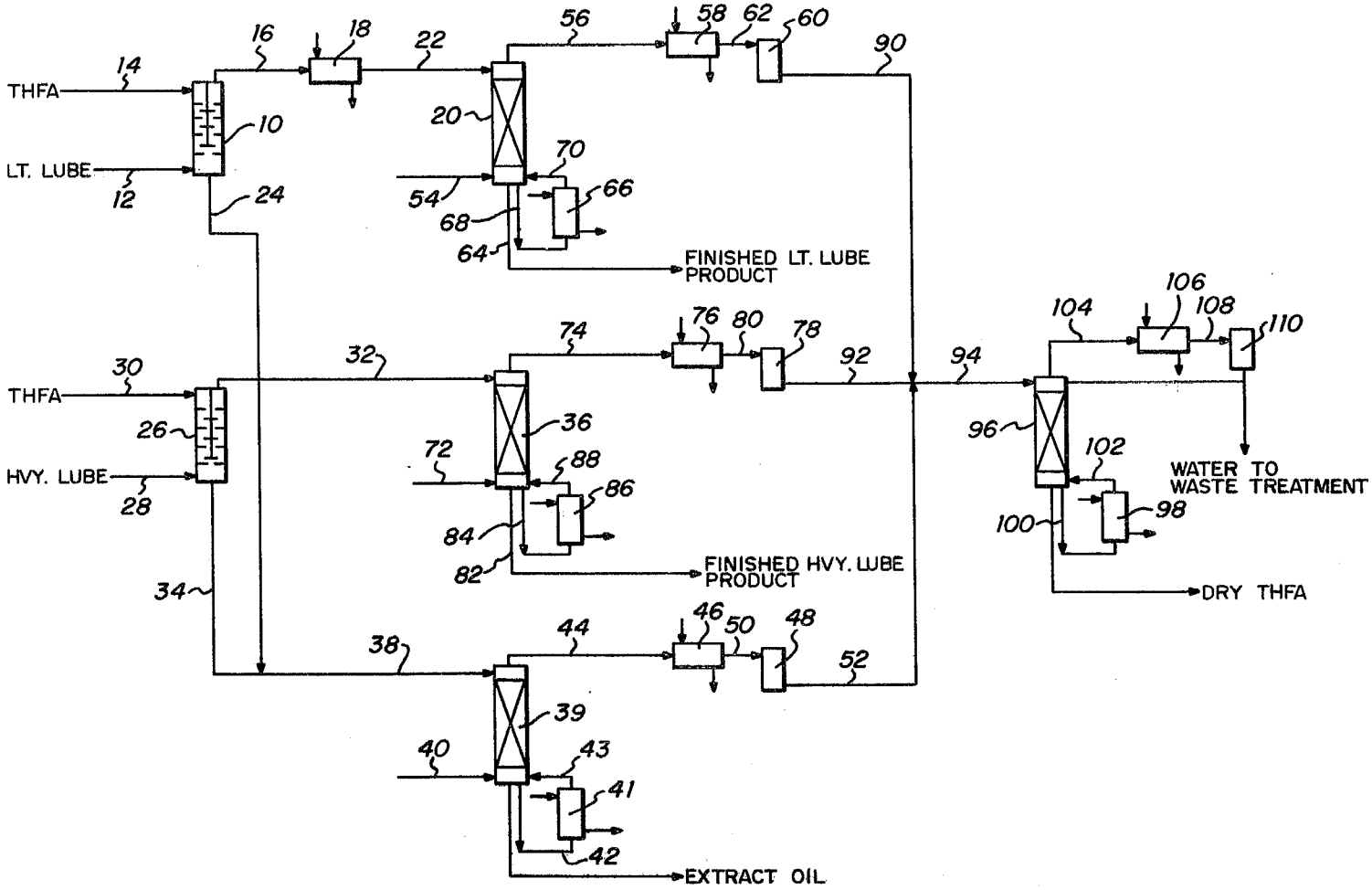
THFA
LT. LUBE
THFA
HVY. LUBE
FINISHED LT. LUBE PRODUCT
FINISHED HVY. LUBE PRODUCT
EXTRACT OIL
WATER TO WASTE TREATMENT
DRY THFA

SOLVENT EXTRACTION PROCESS FOR REREFINING USED LUBRICATING OIL

TECHNICAL FIELD

This invention relates to rerefining used lubricating oil. More particularly, this invention relates to a solvent extraction process for rerefining used lubricating oil that has been fractionated into heavy and light lube fractions.

BACKGROUND ART

This invention relates to a process for the reclamation and rerefining of waste hydrocarbon lubricating oils. In particular, the invention provides an extraction process for removing impurities from waste oil that has been fractionated into light and heavy lube fractions.

Large and increasing volumes of used lubricating oil, particularly crank case oils from diesel and internal combustion engines are produced each year. These waste oils are contaminated with oxidation and degradation products, water, fine particulates, metal and carbon oil additive products. These contamination components render the oils unsuitable for continued use. Waste oils have generally been disposed of by incineration, in land fill, or used in road oiling for dust control because the cost of reclamation and rerefining has been excessive. However, because of the rising cost of hydrocarbon fuels and lubricants, coupled with the ever increasing demand and depletion of these resources, the need for an efficient, low-cost waste oil rerefining process has arisen.

In recent years some small scale rerefining processes have been put into operation in which marketable oils are recovered. However, due to the high cost involved and the resulting narrow margin of profit, such recovery processes represent a small percentage utilization of the total quantity of used lubricating oils.

The ever-increasing scarcity and consequent rising costs of petroleum, particularly high quality lubricating stocks, now presents positive incentives to selectively remove undesirable contaminants from used motor oils and reuse the valuable high quality lubricating components contained in such oils.

Several waste oil rerefining processes are known from the prior art. For example, in U.S. Pat. No. 3,639,229, a process is described where a mixture of an aliphatic monohydric alcohol of from 4 to 5 carbon atoms and a light hydrocarbon is added to waste oil. The mixture settles into three distinct layers. The upper oily layer is recovered, treated with sulfuric acid and thereafter refined by conventional means. In U.S. Pat. No. 3,919,076, a process is described that involves removing water from the waste oil, adding the saturated hydrocarbons solvent, settling the mixture to recover the oil/solvent mix, removing the solvent, vacuum distilling the residual oil to collect selected fractions, hydrogenating the fractions in the presence of a catalyst, stripping hydrogenated oil to remove light ends and filtering the remaining products. U.S. Pat. No. 4,124,492 discloses a process for reclaiming useful hydrocarbon oil from contaminated waste oil in which the waste oil is dehydrated and, thereafter, the dehydrated oil is dissolved in selected amounts of isopropanol. The undissolved waste matter is separated and the residual oil/solvent fraction is distilled to recover the decontaminated oil and solvent. The recovered oil is further clarified by treatment with a bleaching clay or activated carbon at elevated temperatures.

Thus, a need has arisen for an effective method of purifying waste oil that has been fractionated into heavy and light lube fractions, such as disclosed in U.S. patent application Ser. No. 202,019.

DISCLOSURE OF THE INVENTION

The process in accordance with the present invention is preferably utilized with a process that produces heavy and light lube oil fractions from waste lubricating oil, such as the process described in U.S. patent application Ser. No. 202,019, filed Oct. 28, 1980.

In accordance with the present invention, a process is provided for rerefining the purifying used oil containing lubricating oil where the used oil has been fractionated into a light lube oil and a heavy lube oil. The process includes mixing the heavy lube oil with an effective amount of tetrahydrofurfuryl alcohol for extracting impurities from heavy oil. Thereafter, the heavy oil is separated from the tetrahydrofurfuryl alcohol containing impurities removed from the oil. The light lube oil fraction is also mixed with an effective amount of tetrahydrofurfuryl alcohol for removing impurities from the light lube oil. After mixing, the light lube oil is separated from the tetrahydrofurfuryl alcohol containing impurities removed from the oil.

According to a preferred embodiment of the present invention, the heavy lube oil and tetrahydrofurfuryl alcohol mixture is separated to form a heavy oil raffinate and a tetrahydrofurfuryl alcohol extract. The light lube oil and tetrahydrofurfuryl alcohol mixture is similarly separated into a light lube oil raffinate and a tetrahydrofurfuryl alcohol extract. Thereafter, the tetrahydrofurfuryl alcohol is removed from the heavy lube oil raffinate by distilling and steam stripping. Similarly, the tetrahydrofurfuryl alcohol is removed from the light lube oil raffinate by distilling and steam stripping.

The extracts from the extraction units for each of the heavy and light lube fractions are combined and the tetrahydrofurfuryl alcohol solvent is distilled and stripped from the mixture. The solvent is then condensed for reuse in extracting impurities from the light and heavy lube fractions.

Use of tetrahydrofurfuryl alcohol in accordance with the present invention provides a greater selectivity and higher yields of raffinate and has a greater affinity for contaminants found in used lubricating oil.

BRIEF DESCRIPTION OF DRAWINGS

The invention can be more completely understood by reference to the accompanying drawing, in which:

FIG. 1 is a schematic flow sheet of a preferred embodiment of the present invention.

DETAILED DESCRIPTION

According to the present invention, a method is provided for removing impurities from waste lubricating oils that has been fractionated into light and heavy lube fractions. For example, a suitable process for fractionating waste lubricating oil into heavy and light lube fractions is described in U.S. patent application Ser. No. 202,019, having the title "Method of Rerefining Used Lubricating Oil" with Messrs. Laird C. Fletcher and Harold J. Beard being the inventors.

Referring to FIG. 1, the light lube fraction enters an extraction column 10 via a line 12. Extraction device 10 is for example a rotary disc contactor or any other suitable device for bringing the two phases into intimate contact. Tetrahydrofurfuryl alcohol enters extraction device 10 via a line 14. Tetrahydrofurfuryl alcohol, hereinafter referred to as "THFA" is also known as tetrahydrofuryl carbinol and has the following molecular formula: $C_4H_7OCH_2OH$. THFA is a colorless liquid having a mild odor that is miscible with water and has a specific gravity of about 1.054 at 20° C. THFA is hygroscopic and is generally believed to have low toxicity. For example, see the Condensed Chemical Dictionary, 9th Edition published by Van Nostrand Reinhold.

Preferably, the light lube oil fraction and THFA entering extraction device 10 are at a temperature of approximately 150° F. Upon entering extraction device 10, the light lube fraction and THFA are thoroughly mixed in the preferred embodiment of the present invention, the volume ratio of light lube oil to THFA is about 1:1. This parameter is not a limitation upon present invention.

An oil-rich top layer or raffinate exits through a raffinate line 16 from extraction device 10. The raffinate generally contains about 95% oil and about 5% THFA by weight. The raffinate exits line 16 and enters a heat exchanger 18 for heating the raffinate to a temperature of approximately 200° F. After heating in heat exchanger 18, the raffinate is directed to a distillation column 20 via a line 22. The extract exits extraction device 10 via a line 24 to be combined with another line as hereinafter described for distillation and steam stripping.

As shown in FIG. 1, the heavy lube fraction is treated in a manner similar to the treatment for the light lube fraction previously described. The heavy lube oil fraction enters an extraction device 26 via a line 28. The THFA enters extraction device 26 via a line 30. Preferably, the heavy lube oil fraction and THFA entering extraction device 26 are at a temperature of approximately 225° F. The THFA and heavy lube oil are then mixed in extraction device 26 from which exit a raffinate line 32 and an extract line 34. Raffinate line 32 generally contains about 95% oil and 5% THFA by weight. Extract line 34 generally contains by weight about 95% THFA and 5% oil plus the impurities that were removed in the extraction process. Raffinate line 32 is then directed to a heavy oil raffinate distillation and steam stripping column 36, which is hereinafter described.

The extract lines 24 and 34 are combined into a single extract line 38 which is directed to a distillation and steam stripping tower 39. Distillation and steam stripping tower 39 is utilized to distill and steam strip the THFA from the extract. A steam line 40 delivers steam to distillation and steam stripping column 39. The solvent is distilled from the extract and is stripped, exiting through a distillate line 44. Distillation and steam stripping column 39 is preferably operated at a pressure of about 20 millimeters mercury absolute and a temperature at about 160° F. A steam reboiler 41 may be utilized to provide additional heat for distillation and steam stripping tower 39 with a line 42 exiting distillation and steam stripping column 39 and entering reboiler 41 which discharges into distillation and steam stripping column 39 via line 43. After the solvent is distilled, it is condensed by a condenser 46, thereafter entering a storage tank 48 via a line 50. Solvent is removed from storage tank 48 via a line 52 for further treatment as hereinafter described.

As shown in FIG. 1, the light oil raffinate is distilled and steam stripped in distillation column 20. Distillation column 20 is preferably operated at a temperature of about 140° F. and an absolute pressure of about 10 millimeters mercury. Steam is injected through a steam line 54 into distillation column 20. The solvent is distilled and stripped exiting into a distillate line 56. Thereafter, the distillate THFA is condensed in a condenser 58. The condensed THFA thereafter enters a storage vessel 60 via a line 62 where the THFA is stored for further treatment which is hereinafter described.

The residue or finished light lubricating oil exits distillation column 20 through a residue line 64, where it is transferred to storage or to further treatment. Final treatment before actual use as a lubricant may include polishing steps and the addition of specific additives. A steam reboiler 66 may be utilized to provide additional heat for distillation column 20 with a line 68 exiting distillation tower 20 and entering reboiler 66 which discharges into distillation column 20 via a line 70.

The distillation and steam stripping of the heavy lube oil raffinate is similar to the distillation and steam stripping of the light oil raffinate previously described. The heavy oil raffinate enters distillation and steam stripping column 36 via line 32. Steam is injected into stripping column 36 via line 72. The solvent is distilled and stripped, exiting column 36 via a distillate line 74. The THFA distillate is condensed in a condenser 76 where it is thereafter transferred to a storage vessel 78 via a line 80. The THFA is stored for further treatment which is hereinafter described. The residue or finished heavy oil exits stripping column 36 through a residue line 82. Thereafter the finished heavy lube oil may be subjected to further treatment, such as polishing steps or additives may be blended into the heavy lube product depending on the desired use.

Distillation and steam stripping column 36 may also include a reboiler for introducing additional energy into the distillation and steam stripping process. A line 84 exits stripping column 36 and enters steam heated reboiler 86 which discharged into a steam stripping column 36 via a line 88.

In accordance with the preferred embodiment, the final step of the process includes distillation of the recovered THFA to remove water from the THFA to prepare it for re-use. The recovered THFA from holding vessels 48, 60 and 78 is combined via lines 52, 90 and 92, respectively to form a line 94. Line 94 enters a distillation column 96. Distillation column 96 is equipped with a reboiler 98 that recirculates a portion of the column bottoms liquid by use of a line 100 that exits distillation column 96 and enters reboiler 98. Reboiler 98 discharges into line 102 which enters distillation column 96. The distillate of distillation column 96 is primarily water and enters a line 104. Line 104 enters a condenser 106 for condensing the water distillate. The condensate from condenser 106 enters line 108 and is stored in a storage tank 110. A portion of the water in storage tank 110 is recycled into the top of distillation column 96 as reflux. The remainder of the water in storage tank 110 is sent to a waste treatment facility. Dry THFA exits from the bottom of column 96 and is sent to storage or reused at the beginning of the process, for example, in lines 14 and 30.

EXAMPLE 1

Heavy and light lube oil fractions that were obtained by distillation of a waste lube oil were treated in accordance with the method of the present invention. The heavy and light lube oil fractions had the following characteristics:

| SPECIFICATIONS ON LIGHT AND HEAVY LUBE CUTS 1. BEFORE SOLVENT TREATMENT | | |
|---|---|---|
| | LT. LUBE | HEAVY LUBE |
| Gravity °API | 31.6 | 29.4 |
| Vis. @ 100° F. SSU | 96 | 364 |
| Vis. @ 210° F. SSU | 39 | 55 |
| V.I. | 96 | 92 |
| Flash Point °F. | 360 | 445 |
| Fire Point °F. | 390 | 510 |
| T.A.N. | 2.2 | 2.5 |
| Color Metals ppm | 5.0 | Black |
| Silicon | 2 | 2 |
| Sodium | 1 | 1 |
| Phosphorus | 364 | 84 |

The heavy and light lube fractions were treated in the following manner: Equal portions of Lt. Lube oil and THFA were mixed for 1-minute in a separatory funnel at 130° F. The mixture was allowed to settle for 3 hours. The extract layer was drawn off and distilled under vacuum (2.5 mm) and 200° F. to recover the THFA. The extracted oil left was 14% of the original oil used. The THFA was analyzed on an Infra-Red Spectrophotometer (IRS) and the scan was compared with an IRS scan for fresh THFA. The spectra were essentially the same. The raffinate layer was drawn off and distilled under vacuum (2.5 mm) and 200° F. 5% of the original THFA was recovered. It was also subjected to an IRS and compared with fresh THFA. The spectra were essentially the same. The amount of oil recovered was 86%.

The heavy lube oil was treated the same way and 92% of the oil was recovered.

The finished heavy and light lube oils had the following characteristics:

| SPECIFICATIONS ON LIGHT AND HEAVY LUBE CUTS 2. AFTER SOLVENT TREATMENT | | |
|---|---|---|
| | LT. LUBE | HEAVY LUBE |
| Gravity °API | 31.2 | 30.8 |
| Vis @ 100° F. SSU | 98 | 326 |
| Vis @ 210° F. SSU | 39 | 54 |
| V.I. | 96 | 100 |
| Flash Point °F. | 380 | 450 |
| Fire Point °F. | 425 | 510 |
| T.A.N. | 0.05 | 0.05 |
| Color Metals ppm | 1.5 | 3.5 |
| Silicon | 2 | 1 |
| Sodium | 1 | 1 |
| Phosphorus | 0 | 0 |

While this invention has been described with respect to preferred embodiments, it is apparent to one skilled in the art that various modifications will now be apparent and such are intended to be within the scope of the appended claims.

We claim:

1. In a process for rerefining used oil containing lubricating oil, where the used oil is rerefined into a heavy lube oil fraction and a light lube oil fraction, the improvement comprising:

(a) mixing and heavy lube oil fraction with an effective amount of tetrahydrofurfuryl alcohol for removing impurities from the heavy lube oil fraction;

(b) separating the heavy lube oil from the tetrahydrofurfuryl alcohol;

(c) mixing the light lube oil fraction with an effective amount of tetrahydrofurfuryl alcohol for removing impurities from the light lube oil fraction; and (d) separating the light lube oil from the tetrahydrofurfuryl alcohol.

2. The process as recited in claim 1 wherein:

(a) the heavy lube oil and tetrahydrofurfuryl alcohol mixture is separated into a heavy oil raffinate and a heavy oil tetrahydrofurfuryl alcohol extract;

(b) the light lube oil fraction and tetrahydrofurfuryl alcohol mixture is separated into a light oil raffinate and a light oil tetrahydrofurfuryl alcohol extract;

(c) tetrahydrofurfuryl alcohol is removed from the heavy oil raffinate by distilling and steam stripping; and (d) tetrahydrofurfuryl alcohol is removed from the light oil raffinate by distilling and steam stripping.

3. The process as recited in claim 2 further comprising:

distilling and steam stripping the light oil tetrahydrofurfuryl extract and the heavy oil tetrahydrofurfuryl extract to remove the tetrahydrofurfuryl alcohol therefrom.

4. The process as recited in claim 2 further comprising:

(a) combining the tetrahydrofurfuryl alcohol removed from the light oil raffinate, the heavy oil raffinate and the heavy and light oil tetrahydrofurfuryl extracts; and (b) distilling the water present in the mixture set forth in part (a) of this claim to produce dry tetrahydrofurfuryl alcohol that is suitable for use in steps (a) and (c) of claim 1.

5. The process as recited in claim 1 wherein the volume ratio of the heavy lube oil fraction to tetrahydrofurfuryl alcohol is between about 0.5 and 2.0 and the volume ratio of the light lube oil fraction to tetrahydrofurfuryl alcohol is between about 0.5 and 2.0.

6. The process as recited in claim 1 wherein each of the heavy and light lube oil fractions are heated to a temperature in the range of between about 125° F. and 250° F. prior to mixing with tetrahydrofurfuryl alcohol.

7. The process as recited in claim 6 wherein the tetrahydrofurfuryl alcohol is heated to a temperature of between about 125° F. and 250° F. prior to mixing with the lube oil fractions.

8. The process as recited in claim 2 wherein the distilling and steam stripping of the heavy and light oil raffinates occurs at reduced pressure.

9. The process as recited in claim 8 wherein the reduced pressure is between about 10 mm Hg and 100 mg Hg absolute.

10. The process as recited in claim 8 wherein the reduced pressure is about 20 mm Hg absolute at a temperature of about 160° F.

11. The process as recited in claim 3 wherein the distilling and steam stripping of the light and heavy oil extracts occurs at reduced pressure.

12. The process as recited in claim 11 wherein the reduced pressure is between about 10 mm Hg and 100 mm Hg absolute.

13. The process as recited in claim 11 wherein the reduced pressure is about 20 mm Hg absolute at a temperature of about 160° F.

* * * * *

UNITED STATES PATENT AND TRADEMARK OFFICE

CERTIFICATE OF CORRECTION

PATENT NO. : 4,302,325

DATED : November 24, 1981

INVENTOR(S) : Laird C. Fletcher et al.

It is certified that error appears in the above—identified patent and that said Letters Patent is hereby corrected as shown below:

Column 2, line 15, "the" should read --and--.
Column 5, line 65, "and" should read --the--.
Column 6, line 53, "100 mg" should read --100 mm--.

Signed and Sealed this

First Day of June 1982

[SEAL]

*Attest:*

GERALD J. MOSSINGHOFF

*Attesting Officer*

*Commissioner of Patents and Trademarks*